US006632112B2

(12) United States Patent
Nish et al.

(10) Patent No.: US 6,632,112 B2
(45) Date of Patent: Oct. 14, 2003

(54) BUOYANCY MODULE WITH EXTERNAL FRAME

(75) Inventors: Randall W. Nish, Provo, UT (US); Randy A. Jones, Park City, UT (US); Metin Karayaka, Houston, TX (US); Robert G. Schoenberg, Houston, TX (US); Sudhakar Tallavajhula, Houston, TX (US)

(73) Assignee: EDO Corporation, Fiber Science Division, Salt Lake City, UT (US)

( * ) Notice: Subject to any disclaimer, the term of this patent is extended or adjusted under 35 U.S.C. 154(b) by 0 days.

(21) Appl. No.: 09/997,411

(22) Filed: Nov. 29, 2001

(65) Prior Publication Data

US 2002/0115365 A1 Aug. 22, 2002

Related U.S. Application Data

(60) Provisional application No. 60/250,310, filed on Nov. 30, 2000.

(51) Int. Cl.[7] ..... E21B 17/01
(52) U.S. Cl. ..... 441/133; 166/367; 405/224.2
(58) Field of Search ..... 441/133; 405/195.1, 405/224.2; 166/350, 359, 367

(56) References Cited

U.S. PATENT DOCUMENTS

| | | | | |
|---|---|---|---|---|
| 3,470,838 A | | 10/1969 | Daniell | |
| 3,858,401 A | | 1/1975 | Watkins | |
| 3,933,108 A | * | 1/1976 | Baugh | 114/267 |
| 3,952,526 A | | 4/1976 | Watkins et al. | |
| 3,957,112 A | * | 5/1976 | Knibbe et al. | 166/352 |
| RE28,966 E | | 9/1976 | Blockwick | |
| 3,992,889 A | | 11/1976 | Watkins et al. | |
| 4,078,605 A | | 3/1978 | Jones | |
| 4,099,560 A | | 7/1978 | Fischer et al. | |
| 4,176,986 A | | 12/1979 | Taft et al. | |
| 4,256,417 A | | 3/1981 | Bohannon | |
| 4,390,186 A | | 6/1983 | McGee et al. | |
| 4,398,487 A | | 8/1983 | Ortloff et al. | |
| 4,448,266 A | | 5/1984 | Potts | |
| 4,470,722 A | | 9/1984 | Gregory | |
| 4,474,129 A | | 10/1984 | Watkins et al. | |
| 4,511,287 A | | 4/1985 | Horton | |
| 4,596,531 A | | 6/1986 | Schawann et al. | |
| 4,604,961 A | | 8/1986 | Ortloff et al. | |
| 4,606,673 A | | 8/1986 | Daniell | |
| 4,616,707 A | | 10/1986 | Langner | |
| 4,630,970 A | | 12/1986 | Gunderson et al. | |
| 4,634,314 A | | 1/1987 | Pierce | |
| 4,646,840 A | | 3/1987 | Bartholomew et al. | |
| 4,648,747 A | | 3/1987 | Watkins et al. | |
| 4,652,022 A | | 3/1987 | Nichols | |
| 4,702,321 A | | 10/1987 | Horton | |
| 4,740,109 A | | 4/1988 | Horton | |

(List continued on next page.)

FOREIGN PATENT DOCUMENTS

| | | |
|---|---|---|
| GB | 2069450 A | 8/1981 |
| GB | 2133446 A | 7/1984 |
| GB | 2156407 A | 10/1985 |

OTHER PUBLICATIONS

"Filament Wound Preforms for RTM"; SAMPE Journal, vol. 36, No. 2, Mar./Apr. 2000.
"Riser with composite choke/kill lines ready for Gulf of Mexico trials"; Offshore, Mar. 2000.

*Primary Examiner*—Sherman Basinger
(74) *Attorney, Agent, or Firm*—Thorpe North & Western

(57) ABSTRACT

A buoyancy system for deep-water risers of a deep water floating platforms includes an ecto-skeleton formed by a plurality of members to withstand lateral and bending loads, and a buoyant vessel disposed in an interior cavity of the ecto-skeleton to resist pressure loads. The member of the ecto-skeleton can include hollow tubular members having hollow interiors with a buoyant material disposed in the hollow interiors of the tubular members.

36 Claims, 11 Drawing Sheets

U.S. PATENT DOCUMENTS

| | | | |
|---|---|---|---|
| 4,768,455 | A | 9/1988 | Maxson et al. |
| 4,808,034 | A | 2/1989 | Birch |
| 4,821,804 | A | 4/1989 | Pierce |
| 4,934,871 | A | 6/1990 | Kazokas, Jr. |
| 5,044,828 | A | 9/1991 | Berner, Jr. et al. |
| 5,098,132 | A | 3/1992 | Burton |
| 5,330,294 | A | 7/1994 | Guesnon |
| 5,368,648 | A | 11/1994 | Sekizuka |
| 5,421,413 | A | 6/1995 | Allen et al. |
| 5,431,511 | A | 7/1995 | Guy |
| 5,439,060 | A | 8/1995 | Huete et al. |
| 5,439,321 | A | 8/1995 | Hunter |
| 5,447,392 | A | 9/1995 | Marshall |
| 5,542,783 | A | 8/1996 | Pollack |
| 5,558,467 | A | 9/1996 | Horton |
| 5,651,709 | A | 7/1997 | Nandakumar et al. |
| 5,771,975 | A | 6/1998 | Anderson et al. |
| 5,823,131 | A | 10/1998 | Boatman et al. |
| 5,881,815 | A | 3/1999 | Horton, III |
| 5,984,584 | A | 11/1999 | McMillan et al. |
| 6,000,422 | A | 12/1999 | Shigemoto |
| 6,067,922 | A | 5/2000 | Denison et al. |
| 6,092,483 | A | 7/2000 | Allen et al. |
| 6,161,620 | A | 12/2000 | Cox et al. |
| 6,164,348 | A | 12/2000 | Rodwell et al. |
| 6,179,524 | B1 | 1/2001 | Allen et al. |
| 6,193,441 | B1 | 2/2001 | Fisher |
| 6,213,045 | B1 | 4/2001 | Gaber |
| 6,227,137 | B1 | 5/2001 | Allen et al. |
| 6,375,391 | B1 * | 4/2002 | Borseth et al. ..... 114/264 |

* cited by examiner

BUOYANCY MODULE WITH EXTERNAL FRAME

This application claims the benefit of U.S. Provisional Application Serial No. 60/250,310, filed Nov. 30, 2000.

BACKGROUND OF THE INVENTION

1. Field of the Invention

The present invention relates generally to a buoyancy system for supporting a riser of a deep-water, floating oil platform. More particularly, the present invention relates to a buoyancy system having one or more buoyancy modules including a rigid ecto-skeleton to withstand lateral or bending loads, and a buoyancy vessel to withstand internal pressure.

2. Related Art

As the cost of oil increases and/or the supply of readily accessible oil reserves are depleted, less productive or more distant oil reserves are targeted, and oil producers are pushed to greater extremes to extract oil from the less productive oil reserves, or to reach the more distant oil reserves. Such distant oil reserves may be located below the oceans, and oil producers have developed offshore drilling platforms in an effort to extend their reach to these oil reserves.

In addition, some oil reserves are located farther offshore, and thousands of feet below the surface of the oceans. Certain floating oil platforms, known as spars, or Deep Draft Caisson Vessels (DDCV) have been developed to reach these oil reserves. Steel tubes or pipes, known as risers, are suspended from these floating platforms, and extend the thousands of feet to reach the ocean floor, and the oil reserves beyond.

It will be appreciated that these risers, formed of thousands of feet of steel pipe, have a substantial weight, which must be supported by buoyant elements at the top of the risers. The underlying principal of buoyancy cans is to remove a load-bearing connection between the floating vessel and the risers. Steel buoyancy cans (i.e. air cans) have been developed which are coupled to the risers and disposed in the water to help buoy the risers, and eliminate the strain on the floating platform, or associated rigging. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture.

In addition, as risers have become longer by going deeper, their weight has increased substantially. One solution to this problem has been to simply add additional air cans to the riser so that several air cans are attached in series. It will be appreciated that the diameter of the air cans is limited to the width of the well bays within the platform structure, while the length is limited by the practicality of handling the air cans. For example, the length of the air cans is limited by the ability or height of the crane that must lift and position the air can. Another factor limiting air can length is the distance to interference points with the platform structure below the air can. One disadvantage with more and/or larger air cans is that the additional length and larger diameter air cans adds more and more weight which also be supported by the air cans, decreasing the air can's ability to support the risers. Another disadvantage with merely stringing a number air cans is that long strings of air cans may present structural problems themselves. For example, a number of air cans pushing upwards on one another, or on a stem pipe, may cause the cans or stem pipe to buckle.

Vast oil reservoirs have recently been discovered in very deep waters around the world, principally in the Gulf of Mexico, Brazil and West Africa. Water depths for these discoveries range from 1500 to nearly 10,000 ft. Conventional offshore oil production methods using a fixed truss type platform are not suitable for these water depths. These platforms become dynamically active (flexible) in these water depths. Stiffening them to avoid excessive and damaging dynamic responses to wave forces is prohibitively expensive.

Deep-water oil and gas production has thus turned to new technologies based on floating production systems. These systems come in several forms, but all of them rely on buoyancy for support and some form of a mooring system for lateral restraint against the environmental forces of wind, waves and current.

These floating production systems (FPS) sometimes are used for drilling as well as production. They are also sometimes used for storing oil for offloading to a tanker. This is most common in Brazil and West Africa, but not in Gulf of Mexico as of yet. In the Gulf of Mexico, oil and gas are exported through pipelines to shore.

Drilling, production, and export of hydrocarbons all require some form of vertical conduit through the water column between the sea floor and the FPS. These conduits are usually in the form of steel pipes called "risers." Typical risers are either vertical (or nearly vertical) pipes held up at the surface by tensioning devices; flexible pipes which are supported at the top and formed in a modified catenary shape to the sea bed; or steel pipe which is also supported at the top and configured in a catenary to the sea bed (Steel Catenary Risers—commonly known as SCRs).

The flexible and SCR type risers may in most cases be directly attached to the floating vessel. Their catenary shapes allow them to comply with the motions of the FPS due to environmental forces. These motions can be as much as 10–20% of the water depth horizontally, and 10s of ft vertically, depending on the type of vessel, mooring and location.

Top Tensioned risers (TTRs) typically need to have higher tensions than the flexible risers, and the vertical motions of the vessel need to be isolated from the risers. TTRs have significant advantages for production over the other forms of risers, however, because they allow the wells to be drilled directly from the FPS, avoiding an expensive separate floating drilling rig. Also, wellhead control valves placed on board the FPS allow for the wells to be maintained from the FPS. Flexible and SCR type production risers require the wellhead control valves to be placed on the seabed where access and maintenance is expensive. These surface wellhead and subsurface wellhead systems are commonly referred to as "Dry tree" and "Wet Tree" types of production systems, respectively.

Drilling risers must be of the TTR type to allow for drill pipe rotation within the riser. Export risers may be of either type.

TTR tensioning systems are a technical challenge, especially in very deep water where the required top tensions can be 1000 kips or more. Some types of FPS vessels, e.g. ship shaped hulls, have extreme motions which are too large for TTRs. These types of vessels are only suitable for flexible risers. Other, low heave (vertical motion), FPS designs are suitable for TTRs. This includes Tension Leg Platforms TLP), Semi-submersibles and Spars, all of which are in service today.

Of these, only the TLP and Spar platforms use TTR production risers. Semi-submersibles use TTRs for drilling risers, but these must be disconnected in extreme weather. Production risers need to be designed to remain connected to the seabed in extreme events, typically the 100 year return period storm. Only very stable vessels are suitable for this.

Early TTR designs employed on semi-submersibles and TLPs used active hydraulic tensioners to support the risers. As tensions and stroke requirements grow, these active tensioners become prohibitively expensive. They also require large deck area, and the loads have to be carried by the FPS structure.

Spar type platforms recently used in the Gulf of Mexico use a passive means for tensioning the risers. These type platforms have a very deep draft with a central shaft, or centerwell, through which the risers pass. Buoyancy cans inside the centerwell provide the top tension for the risers. These cans are more reliable and less costly than active tensioners.

Types of spars include the Caisson Spar (cylindrical), and the "Truss" spar. There may be as many as 40 production risers passing through a single centerwell. The Buoyancy cans are typically cylindrical, and they are separated from each other by a rectangular grid structure referred to a riser "guides".

These guides are attached to the hull. As the hull moves the risers are deflected horizontally with the guides. However, the risers are tied to the sea floor, hence as the vessel moves the guides slide up and down relative to the risers (from the viewpoint of a person on the vessel it appears as if the risers are sliding in the guides).

A wellhead at the sea floor connects the well casing (below the sea floor) to the riser with a special Tieback Connector. The riser, typically 9–14" pipe, passes from the tieback connector through the bottom of the spar and into the centerwell. Inside the centerwell the riser passes through a stem pipe, or conduit, which goes through the center of the buoyancy cans. This stem extends above the buoyancy cans themselves and supports the platform to which the riser and the surface wellhead are attached. The buoyancy cans need to provide enough buoyancy to support the required top tension in the risers, the weight of the cans and stem, and the weight of the surface wellhead.

Since the surface wellhead ("dry tree") move up and down relative to the vessel, flexible jumper lines connect the wellhead to a manifold which carries the product to a processing facility to separate water, oil and gas from the well stream.

Spacing between risers is determined by the size of the buoyancy cans. This is an important variable in the design of the spar vessel, since the riser spacing determines the centerwell size, which in turn contributes to the size of the entire spar structure. This issue becomes increasingly more critical as production moves to deeper water because the amount of buoyancy required increases with water depth. The challenge is to achieve the buoyancy needed while keeping the length of the cans within the confines of the centerwell, and the diameters to reasonable values.

The efficiency of the buoyancy cans is compromised by several factors:

Internal Stem

The internal stem is typically flooded and provides no buoyancy. Its size is dictated by the diameter of the sea floor tieback connector, which is deployed through the stem. These connectors can be up to 50" in diameter.

Solutions to this loss of buoyancy include:

1) adding compressed air to the annulus between the riser and the stem wall after the riser is installed, and
2) making the buoyancy cans integral with the riser so they are deployed after the tieback connector is installed.

Adding air to the annulus is efficient use of the stem volume, but the amount of buoyancy can be so large that if a leak occurs there could be damage to a riser. The buoyancy tanks are usually subdivided so that leakage and flooding of any one, or even two, compartments will not cause damage.

Making the buoyancy cans integral with the risers has been used, but this requires a relatively small can diameter for deployment with the floating production platform, and the structural connections between the cans and the riser are difficult to design.

Circular Cans

The circular geometry of the cans leaves areas of the centerwell between cans flooded.

Weight of the Cans

The buoyancy cans are typically constructed out of steel and their weight can be a significant design issue. The first spar buoyancy cans were designed to withstand the full hydrostatic head of the sea, and their weight reflected the thicker walls necessary to meet this requirement. Subsequent designs were based on the cans being open to the sea at their lower end, with compressed air injected inside to evacuate the water. These cans only have to be designed for the hydrostatic pressure corresponding to the can length, and this is an internal pressure requirement rather than the more onerous external pressure requirement.

SUMMARY OF THE INVENTION

It has been recognized that it would be advantageous to develop a buoyancy system with greater structural capacity, lighter weight, and greater buoyancy.

The invention provides a buoyancy system that can be connected to a riser to provide buoyancy for the riser. The riser can extend substantially from a floating platform on or under the ocean's surface, to the floor or the ocean. The buoyancy system includes a rigid ecto-skeleton couplable to the riser and defining an interior cavity configured to receive the riser therethrough. The ecto-skeleton can be movably disposed in the floating platform, and can withstand lateral and bending loads. A buoyant vessel is disposed in the interior cavity of the ecto-skeleton, and contains a buoyant material to provide buoyancy for the riser. The buoyant material can include air or pressurized air. Thus, the buoyant vessel can withstand pressure loads. When submerged, the buoyancy system, or ecto-skeleton and buoyant vessel, provides buoyancy for the riser, while withstanding lateral and bending loads.

In accordance with a more detailed aspect of the invention, the vessel can include a fiber composite vessel with a vessel wall including a fiber composite material.

In accordance with another more detailed aspect of the invention, the ecto-skeleton can include a plurality of members forming an external framework. The members can include 1) longitudinal members oriented longitudinally with respect to the framework, and 2) lateral members oriented laterally with respect to the framework, the longitudinal and lateral members being connected at intersections.

In accordance with another more detailed aspect of the invention, the members of the framework can include tubular members having hollow interiors with a buoyant material disposed therein. In one aspect, the ecto-skeleton has neutral buoyancy. Thus, the exto-skeleton itself contributes to buoyancy.

In accordance with another more detailed aspect of the invention, a plurality of cladding members can be disposed in gaps between proximal members. The cladding members can include a buoyant material to further contribute to buoyancy and efficiently utilize space in the floating platform.

In accordance with another more detailed aspect of the invention, the ecto-skeleton can have a square cross-sectional shape. The vessel, however, can have a circular cross-sectional shape. A plurality of inserts can be disposed in the ecto-skeleton between the framework and the vessel at corners of the square cross-sectional shape. The inserts can include a buoyant material to further contribute to buoyancy and efficiently utilize space in the floating platform, and in the ecto-skeleton.

In accordance with another more detailed aspect of the invention, the buoyancy system can be modular. Thus, the ecto-skeleton can be a first ecto-skeleton and include a second ecto-skeleton attachable to the first. A plurality of mating protrusions and indentations can be disposed on the first and second ecto-skeletons.

In accordance with another more detailed aspect of the invention, the ecto-skeleton and the vessel can have a circular cross-sectional shape.

Additional features and advantages of the invention will be apparent from the detailed description which follows, taken in conjunction with the accompanying drawings, which together illustrate, by way of example, features of the invention.

DETAILED DESCRIPTION

Figure 1:
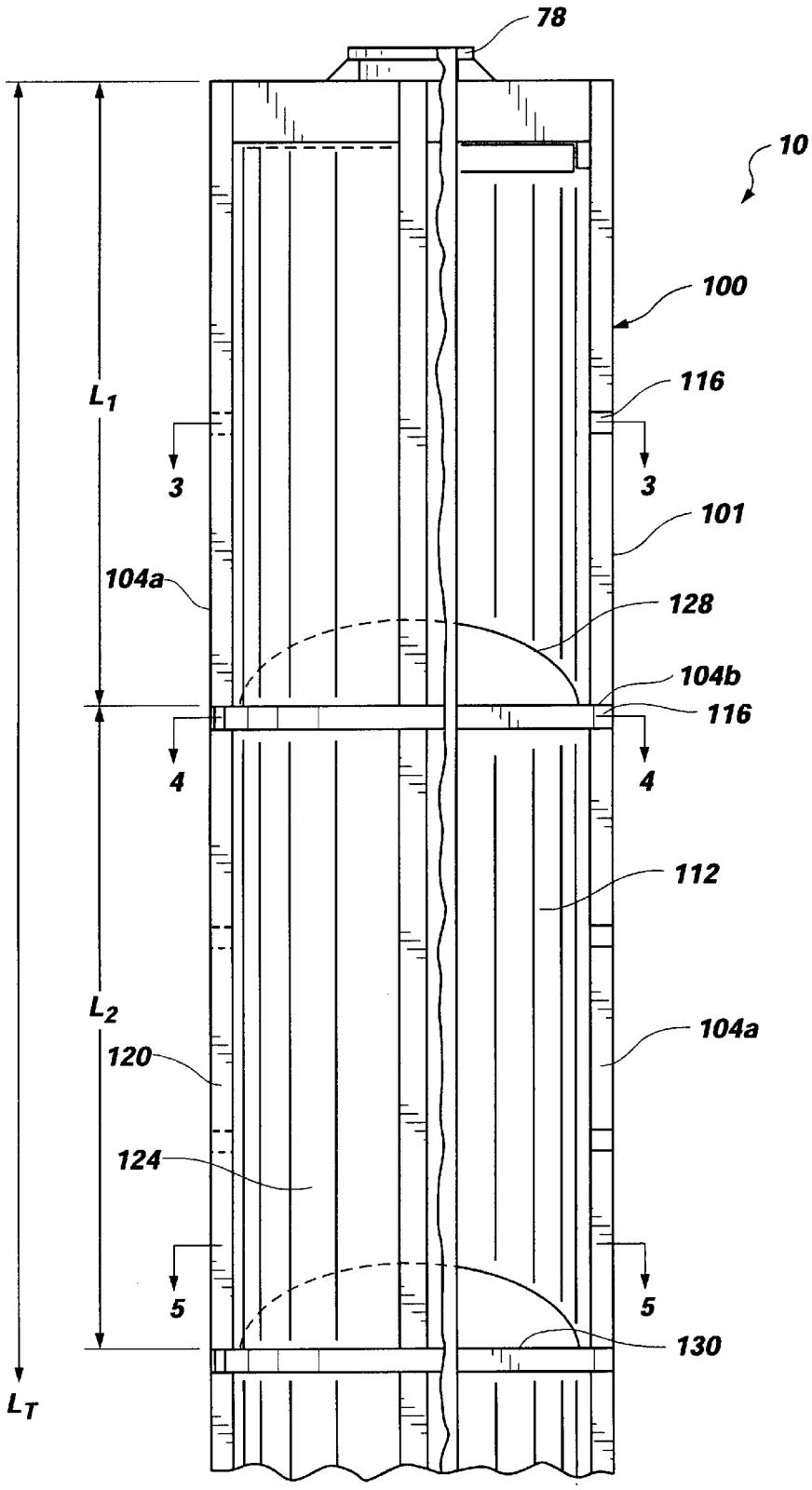
FIG. 1 is a partial side view of a buoyancy system in accordance with the present invention.
Figure 2:
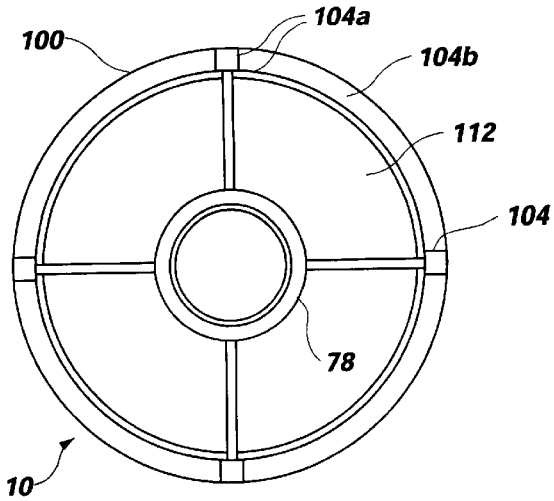
FIG. 2 is an end view of the buoyancy system of FIG. 1.
Figure 3:
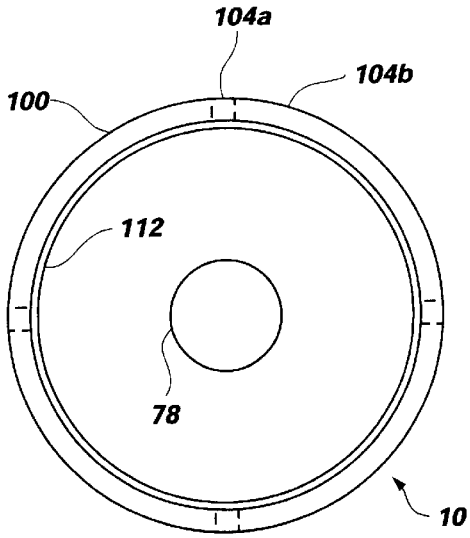
FIG. 3 is a cross-sectional end view of the buoyancy system of FIG. 1 taken along line 3—3.
Figure 4:
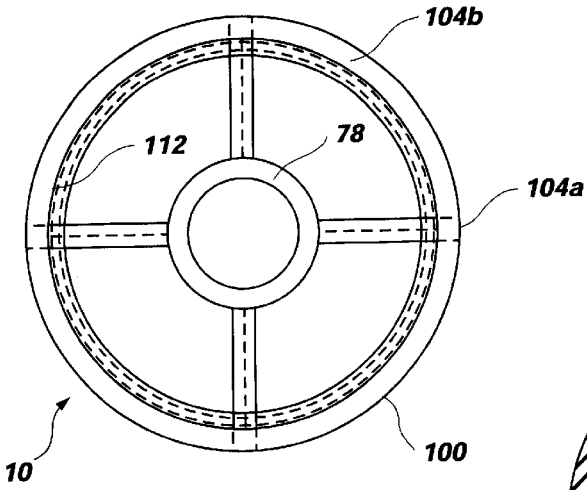
FIG. 4 is a cross-sectional end view of the buoyancy system of FIG. 1 taken along line 4—4.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 11–14, a deep water, floating oil platform, indicated generally at 8, is shown with a buoyancy system, indicated generally at 10, in accordance with the present invention. Deep water oil drilling and production is one example of a field that may benefit from use of such a buoyancy system 10. The term "deep water, floating oil platform" is used broadly herein to refer to buoyant platforms located above and below the surface, such as are utilized in drilling and/or production of fuels, such as oil and gas, typically located off-shore in the ocean at locations corresponding to depths of over several hundred or thousand feet, including classical, truss, and concrete spar-type platforms or Deep Draft Caisson Vessels, etc. Thus, the fuel, oil or gas reserves are located below the ocean floor at depths of over several hundred or thousand feet of water.

Figure 11:
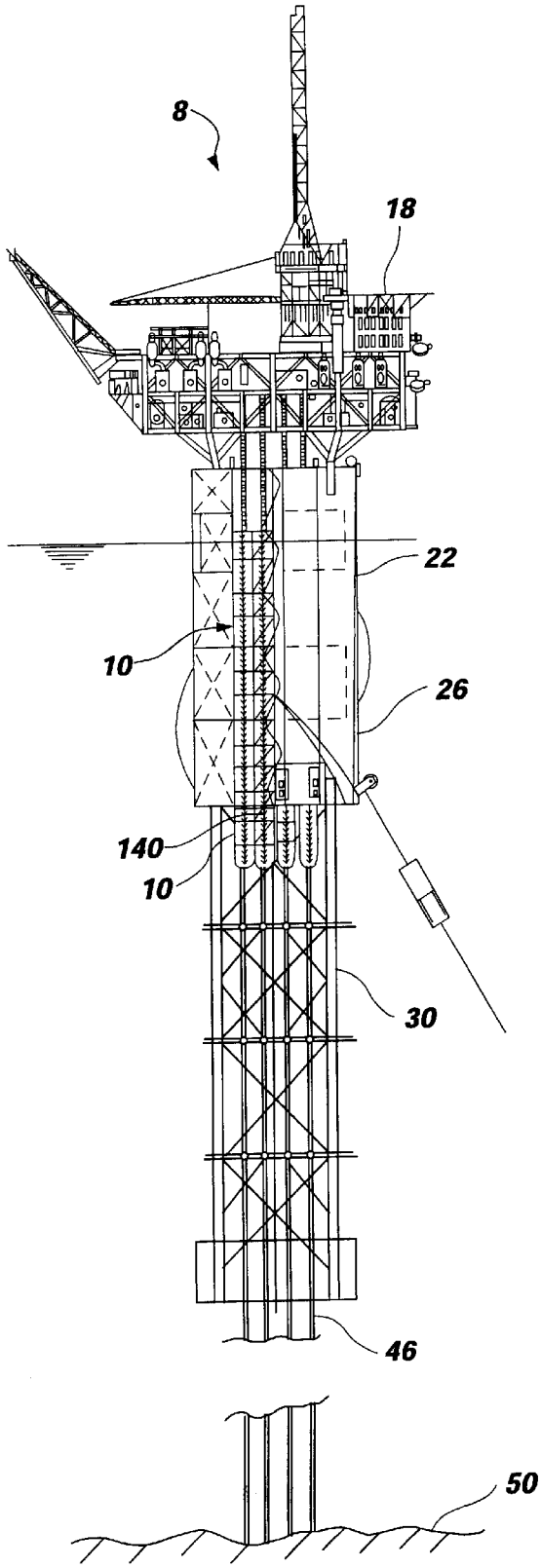
FIG. 11 is a side elevation view of the floating platform utilizing the buoyancy system of the present invention shown disposed in the water above the sea floor.

A truss-type, floating platform 8 is shown in FIG. 11, and has above-water, or topside, structure 18, and below-water, or submerged, structure 22. The above-water structure 18 includes several decks or levels which support operations such as drilling, production, etc., and thus may include associated equipment, such as a work over or drilling rig, production equipment, personnel support, etc. The submerged structure 22 may include a hull 26, which may be a full cylinder form. The hull 26 may include bulkheads, decks or levels, fixed and variable seawater ballasts, tanks, etc. The fuel, oil or gas may be stored in tanks in the hull. The platform 8, or hull, also has mooring fairleads to which mooring lines, such as chains or wires, are coupled to secure the platform or hull to an anchor in the sea floor.

The hull 26 also may include a truss or structure 30. The hull 26 and/or truss 30 may extend several hundred feet below the surface 34 of the water, such as 650 feet deep. A centerwell or moonpool 38 (See FIG. 12) is located in the hull 26 or truss structure 30. The buoyancy system 10 is located in the hull 26, truss 30, and/or centerwell 38. The centerwell 38 is typically flooded and contains compartments 42 (FIG. 12) or sections for separating the risers and the buoyancy system 10. The hull 26 provides buoyancy for the platform 8 while the centerwell 38 protects the risers and buoyancy system 10.

Figure 12:
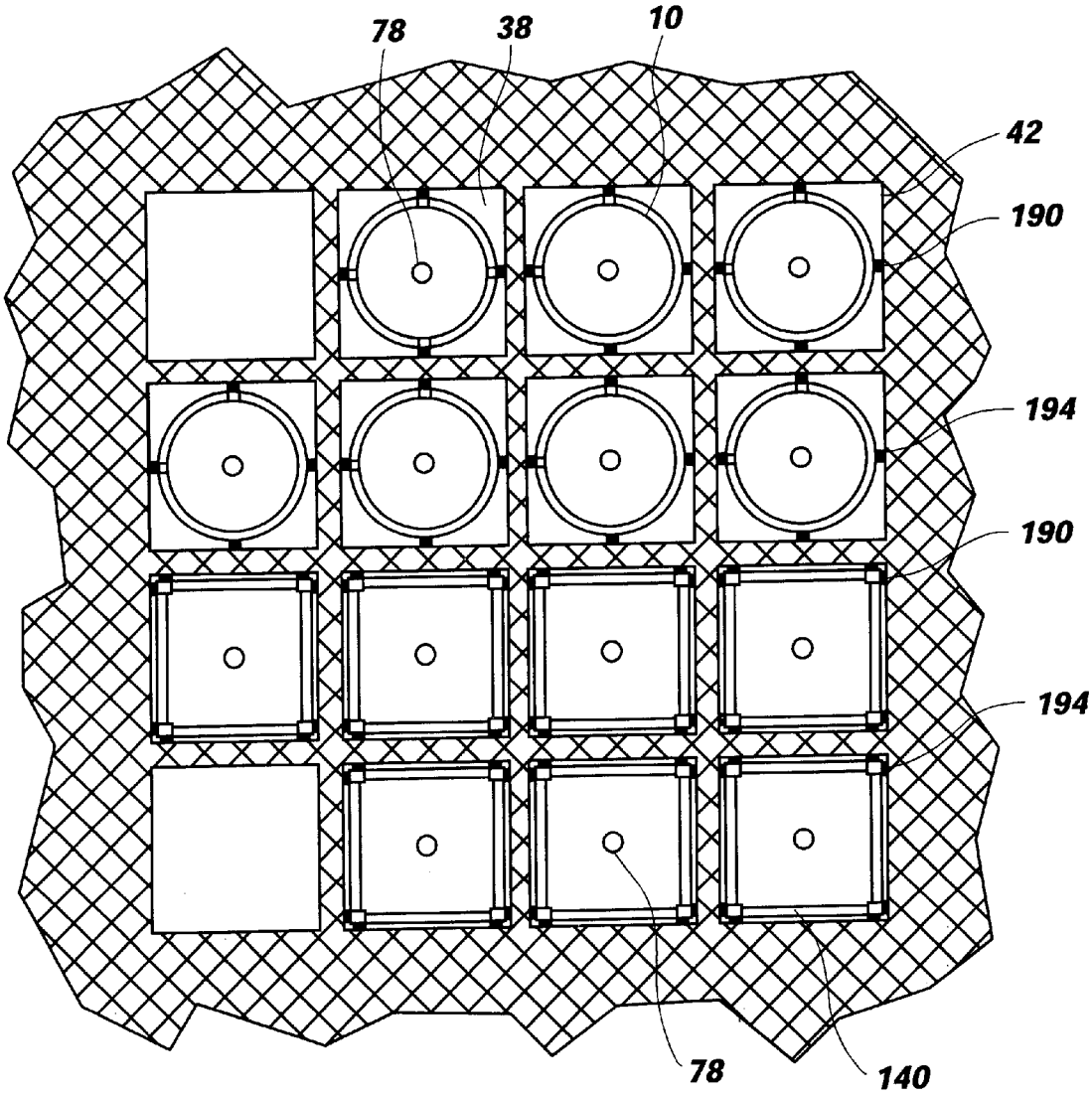
FIG. 12 is a partial cross-sectional end view of the floating platform utilizing the buoyancy system of the present invention.
Figure 13:
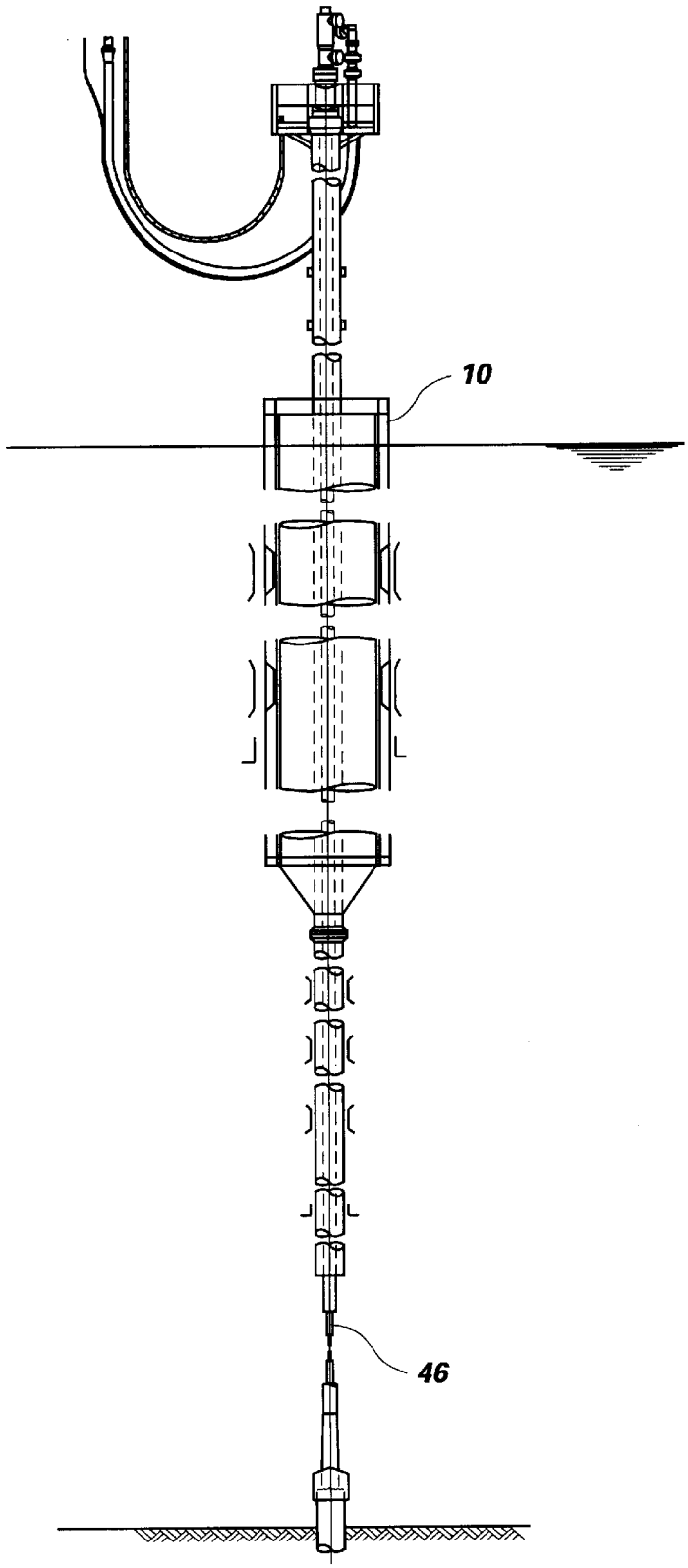
FIG. 13 is a partial schematic view of a riser system utilizing the buoyancy system of the present invention.

It is of course understood that the truss-type, floating platform 8 depicted in FIGS. 11 and 12 is merely exemplary of the types of floating platforms that may be utilized. For example, other spar-type platforms may be used, such as classic spars, or concrete spars.

The buoyancy system 10 supports deep water risers 46 which extend from the floating platform 8, near the water surface 34, to the bottom 50 of the body of water, or ocean floor. The risers 46 are typically steel pipes or tubes with a hollow interior for conveying the fuel, oil or gas from the reserve, to the floating platform 8. The term "deep water risers" is used broadly herein to refer to pipes or tubes extending over several hundred or thousand feet between the reserve and the floating platform 8, including production risers, drilling risers, and export/import risers. The risers may extend to a surface platform or a submerged platform. The deep-water risers 46 are coupled to the platform 8 by a thrust plate located on the platform 8 such that the risers 46 are suspended from the thrust plate. In addition, the buoyancy system 10 is coupled to the thrust plate such that the buoyancy system 10 supports the thrust plate, and thus the risers 46.

Preferably, the buoyancy system 10 is utilized to access deep-water oil and gas reserves with deep-water risers 46 which extend to extreme depths, such as over 1000 feet, more preferably over 3000 feet, and most preferably over 5000 feet. It will be appreciated that thousand feet lengths of steel pipe are exceptionally heavy, or have substantial weight. It also will be appreciated that steel pipe is thick or dense (i.e. approximately 0.283 lbs/in$^3$), and thus experiences relatively little change in weight when submerged in water, or seawater (i.e. approximately 0.037 lbs/in$^3$). Thus, for example, steel only experiences approximately a 13% decrease in weight when submerged. Therefore, thousands of feet of riser, or steel pipe, is essentially as heavy, even when submerged.

The buoyancy system 10 includes one or more buoyancy modules, which are submerged and filled with a buoyant material, such as air, to produce a buoyancy force to buoy or support the risers 46. The buoyancy modules can be elongated, vertically oriented, submerged, and coupled to one or more risers 46 via the thrust plate, or the like. In addition, the buoyancy modules may include a stem pipe 78 extending therethrough concentric with a longitudinal axis of the module. The stem pipe 78 may be sized to receive one or more risers 46 therethrough.

Therefore, the risers 46 exert a downward force due to their weight on the thrust plate, while the buoyancy module exerts an upward force on the thrust plate 54. Preferably, the upward force exerted by the one or more buoyancy modules is equal to or greater than the downward force due to the weight of the risers 46, so that the risers 46 do not pull on the platform 8 or rigging.

As stated above, the thousands of feet of risers 46 exert a substantial downward force on the buoyancy system 10 or buoyancy module. It will be appreciated that the deeper the targeted reserve, or as drilling and/or production moves from hundreds of feet to several thousands of feet, the risers 46 will become exceedingly more heavy, and more and more buoyancy force will be required to support the risers 46. It has been recognized that it would be advantageous to optimize the systems and processes for accessing deep reserves, to reduce the weight of the risers and platforms, and increase the buoyant force. In addition, it will be appreciated that the risers 46 move with respect to the platform 8 and centerwell 38, and that such movement between the buoyant modules and centerwell 38 can exert lateral forces and/or bending forces on the buoyant modules. Thus, it has been recognized that it would be advantageous to increase the structural integrity of the buoyancy modules, while at the same time reducing weight and increasing buoyancy.

Referring to FIGS. 1 through 10, buoyancy systems in accordance with the present invention are shown. One embodiment has a circular cross-sectional shape, as shown in FIGS. 1 through 6, while another embodiment has a square cross-sectional shape is shown in FIGS. 7 through 10. Referring now to FIGS. 1 through 6, the buoyancy system 10 advantageously includes an ecto-skeleton, or external framework, which is substantially rigid. The ecto-skeleton 100 or external framework may have a truss-like configuration, and be configured to resist or withstand lateral, radial, and/or bending forces. As indicated above, the buoyancy system 10 is moveably disposed in the centerwell 38 of the platform 8. Thus, the ecto-skeleton 100 or framework is moveably disposed in the centerwell 38. Also, as discussed above, movement of the riser 46 with respect to the platform 8 may impart movement or bending between the buoyancy system 10 or ecto-skeleton 100, and the centerwell 38. Such movement or bending may impart lateral and/or bending stresses on the buoyancy system 10. Thus, ecto-skeleton 100 is configured to withstand and resist these forces.

The framework includes a plurality of members 104 attached together to form the framework and ecto-skeleton 100. As stated above, the members 104 may be configured in a truss-like configuration to form a truss framework. The members 104 may include longitudinal members 104*a* extending longitudinally with respect to the buoyancy system 10 or module, and lateral members 104*b* extending laterally with respect to the buoyancy system. The longitudinal and lateral members 104*a* and *b* can traverse one another and be attached at their intersections. The compartments 42 in the centerwell 38 may have a circular shape. Thus, the buoyancy system 10 and ecto-skeleton 100 may have a circular cross-sectional shape. Thus, the lateral members 104*b* may have circular configuration. The ecto-skeleton 100 or framework, or members 104, may be formed of steel, aluminum, composites, titanium, or the like.

An interior cavity 108 is formed in the ecto-skeleton 100 between opposing members. The riser 46 extends through the interior cavity 108 or the framework or ecto-skeleton 100. In addition, the stem pipe 78 can extend through the interior cavity 108 or the framework or ecto-skeleton 100.

A vessel 112 is disposed in the interior cavity 108 of the ecto-skeleton 100. The vessel 112 includes a buoyant material, such as air, to provide a buoyant force. The vessel 112 can be attached to the ecto-skeleton 100 or to the members 104 thereof. The vessel 112 can have a circular cross-sectional shape configured to match the cross-sectional shape of the ecto-skeleton 100 and mate within the interior cavity 108 of the ecto-skeleton 100. In addition, the riser 46 and the stem pipe 78 can extend through the vessel 112.

The vessel 112 preferably is a thin walled vessel configured to resist or withstand pressure loads within the vessel 112. The vessel 112 may be pressurized, or may contain pressurized air. The vessel 112 advantageously can be configured to have thinner walls designed and configured to resist pressure loads within the vessel 112, because the ecto-skeleton 100 or framework is designed and configured to withstand the lateral and/or bending loads. Thus, the pressure vessel 112 advantageously can have thinner walls. Preferably the vessel 112 has a vessel wall formed to a composite material, and preferably has a thickness between approximately one-quarter and one-half inch.

The vessel 112 advantageously can be a composite vessel, or can include a vessel wall formed of a fiber reinforced resin. The composite vessel 112 or vessel wall preferably has a density of approximately 0.057 to 0.072 lbs/in$^3$. Therefore, the composite vessel 112 is substantially lighter than prior art metal cans. In addition, the composite vessel 112 or vessel wall advantageously experiences a significant decrease in weight, or greater decrease than metal or steel, when submerged. Preferably, the composite vessel 112 experiences a decrease in weight when submerged between approximately 25 to 75 percent, and most preferably between approximately 40 to 60 percent. Thus, the composite vessel 112 experiences a decrease in weight when submerged greater than three times that of steel.

The buoyancy system 10, one or more buoyancy modules, or vessel 112 and ecto-skeleton 100, preferably have a volume sized to provide a buoyancy force at least as great as the weight of the submerged riser 46. It will also be appreciated that motion of the floating platform 8, water motion, vibration of the floating platform 8 and associated equipment, etc., may cause the risers 46 to vibrate or move. Thus, the buoyancy system 10 preferably has a volume sized to provide a buoyant force at least approximately 20 to 200 percent greater (1.2 to 2 times greater) than the weight of the submerged risers 46 in order to pull the risers 46 straight and tight to avoid harmonics, vibrations, and/or excess motion.

Thus, the buoyancy system 10 advantageously includes an ecto-skeleton 100 or framework for substantially resisting or withstanding lateral and/or bending forces, and a vessel 112 for substantially resisting internal pressure loads. Thus, the vessel 112 can have thinner walls to reduce the weight.

In addition, the plurality of members 104 forming the ecto-skeleton 100 or framework preferably includes hollow tubular members having hollow interiors 116. In addition, a buoyant material advantageously is disposed in the hollow interior 116 of the tubular members. The buoyant material can be air, foam, or the like. Thus, the tubular members may be sealed in order to prevent fluid from entering therein. The hollow nature of the tubular members, and thus the hollow nature of the ecto-skeleton 100 or framework, allows the ecto-skeleton 100 or framework to have some buoyancy itself. Preferably, the tubular members are sized, or the hollow interiors are sized and the walls of the tubular member are sized such that the ecto-skeleton 100 or framework has neutral buoyancy.

A plurality of gaps 120 is formed between proximal members 104 of the ecto-skeleton 100 or frame work, and the internal cavity and exterior of the ecto-skeleton 100. A plurality of buoyant cladding members 124 advantageously is disposed in the gaps 120. The cladding members 124 preferably are sized and shaped to substantially fill the gaps 120. For example, the gaps 120 between proximal members 104 may have an elongated arcuate shape, so that the cladding members 124 similarly have an elongated arcuate shape. In addition, the cladding members 124 may have a thickness to match the thickness of the members 104 and, thus, extend between the interior cavity and the exterior of the ecto-skeleton 100 or framework.

The buoyant cladding members 124 include a buoyant material, such as foam, to help produce a buoyancy force in addition to the vessel 112 and ecto-skeleton 100. The cladding members 124 can be entirely formed of foam, and thus be foam panels. Alternatively, the cladding members 124 can be containers or vessels containing buoyant material, such as foam or air. As discussed above, the compartments 42 of the wellbay 38 of the platform 8 may have a circular cross-sectional shape, dictating the circular cross-sectional shape of the buoyancy system 10. While the vessel 112 can substantially fill the internal cavity 108 of the ecto-skeleton 100, the buoyant cladding members 124 could substantially fill the gaps 120 between the members 104 of the ecto-skeleton 100, thus making use of all available space and maximizing buoyancy. The cladding 124 also can protect the vessel 112.

The density of the cladding members 124 can be tailored as desired. For example, high-density foam can be used at deeper depths, where water pressure is higher, while lower density foam can be used at shallower depths, where water pressure is less. The density of an entire cladding member 124 can be consistent, with different density cladding members being located at different locations along the ecto-skeleton 100 or framework. Alternatively, the density of the cladding member can vary along the length the cladding member.

Partitions 128 can be formed in the interior of the vessel 112 to divide the vessel 112 into a number of compartments. Thus, the partitions 128 can prevent failure in one compartment from being a catastrophic failure of the entire vessel.

In addition, support members 130 can extend between the ecto-skeleton 100 and the stem 78 to support the stem 78 within the vessel 112 and ecto-skeleton 100.

Referring now to FIGS. 7 through 10, another buoyancy system 140 is shown which is similar in many respects to the buoyancy system 10 described above, except that the buoyancy system 140 has a square cross-sectional shape or configuration. The compartments 42 of the wellbay 38 of the platform 8 can also have a square cross-sectional opening. Thus, the buoyancy system 140 preferably has a square cross-sectional shape to efficiently utilize the space and maximize buoyancy. The buoyancy system 140 similarly has an ecto-skeleton 144 or frame work with a plurality of members 104, including longitudinal members 104*a,* lateral members 104*b* and diagonal members 104*c,* extending diagonally with respect to the longitudinal and lateral members 104*a* and *b*. The ecto-skeleton 144 or framework has a square cross-sectional shape configured to match a square opening in the centerwell 38. The vessel 112 is disposed in the internal cavity 148 of the ecto-skeleton 144. The vessel still may have a circular cross-sectional shape, as described above, because it is believed that such circular vessels 112 have superior abilities or efficiencies in resisting internal pressure loads. Alternatively, the vessel may have square cross-sectional shape.

Again, gaps 152 may be formed between the members 104. Buoyant cladding members 156 are disposed in the gaps 152. The gaps 152 may have a triangular shape due to the diagonal members 104*c*. Thus, the cladding members 156 also may have a triangular shape in order to match and mate with the triangular gaps 152.

As discussed above, the ecto-skeleton 144 or frame work may have a square cross-sectional shape to match a square cross-sectional opening in the centerwell 38, while the vessel 112 has a circular cross-sectional shape to better withstand internal pressure forces. Thus, a plurality of buoyant inserts 160 can be inserted in the internal cavity 148 of the ecto-skeleton 144 between the frame work and the vessel 112 at the corners of the square cross-sectional shape, or at the corners of the internal cavity 148. The inserts 160 may be sized and shaped to substantially fill the corner space between the vessel 112 and ecto-skeleton 144. Thus, the inserts 160 may have a cross-sectional shape defined by two sides at a right angle to mate with the corner of the ecto-skeleton, and a third arcuate side configured to match the circular cross-section of the vessel 112. Alternatively, the inserts 162 may have a triangular cross-sectional shape. Furthermore, the inserts 164 may be circular and include a plurality of inserts to fill the space. Thus, the buoyant inserts 160, 162 or 164 substantially fill the interior cavity 148 of the ecto-skeleton 144 along with the vessel to more efficiently utilize the space and maximize buoyancy.

As discussed above, the buoyancy system 140 can be modular and include a plurality of buoyancy modules, which can be attached together to form the buoyancy system 10 or 140. Such a system allows the buoyancy modules to be manufactured, transported and installed in smaller, more easily handled sizes.

Figure 10:
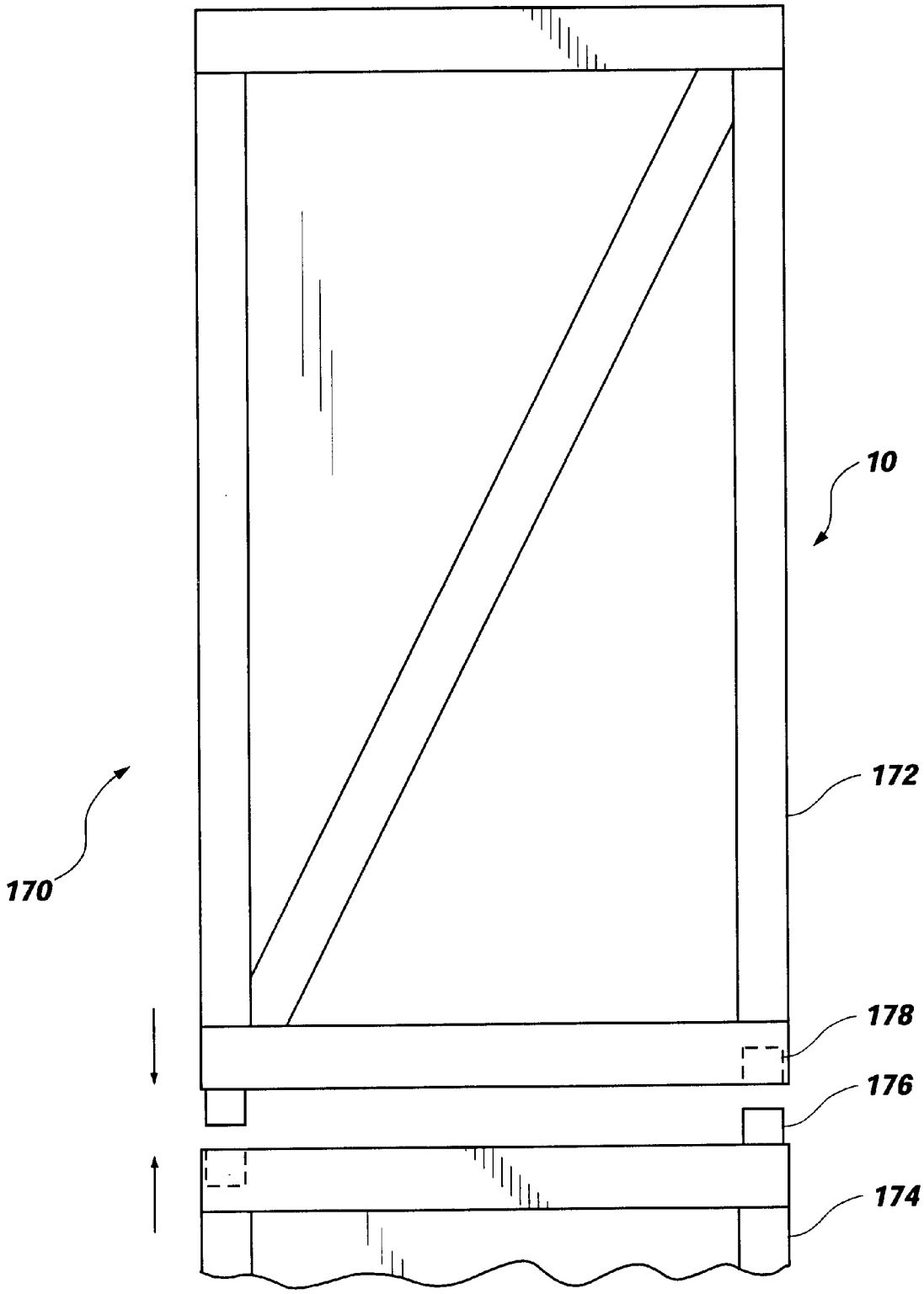
FIG. 10 is a partial side view of a modular buoyancy system in accordance with the present invention showing a pair of buoyancy modules being attached together.

Referring to FIG. 10, a modular buoyancy system 170 is shown with a plurality of buoyancy modules, such as first and second buoyancy modules 172 and 174. The buoyancy modules 172 and 174 may be similar to the buoyancy systems 10 and 140 described above, and include ecto-skeletons, and have many appropriate cross-sectional shapes, such as circular or square. The buoyancy modules 172 and 174 may include a male protrusion 176 extending from the frame or ecto-skeleton at an end thereof, and have female indentations 178 formed in the frame or ecto-skeleton at the ends, such that the protrusions 176 and indentations 178 match and mate. The protrusions and indentations 176 and 178 allow the buoyancy modules 172 and 174 to be appropriately aligned for attachment and strengthen the connection between the two. The buoyancy modules 172 and 174 may be attached in any appropriate manner, such as welding or bolting.

Referring to FIG. 11, the floating platform 8 of hull 26 may include a centerwell 38 with a grid structure with one or more square compartments 42, as described above. The risers 46 and buoyancy modules, or systems, are disposed in the compartments 42 and separated from one another by the grid structure. The compartments 42 may have a circular cross-section, or a square cross-section with a cross-sectional area. The buoyancy modules can have a non-circular cross-section, as described above, with a cross-sectional area greater than approximately 79 percent of the cross-sectional area of the compartment 42. Thus, the cross-sectional area, and thus the size, of the buoyancy module is designed to maximize the volume and buoyancy force of the buoyancy module.

The buoyancy module or vessel preferably has a diameter or width of approximately 3 to 4 meters, and a length of approximately 10 to 20 meters. The diameter or width of the buoyancy modules is limited by the size or width of the compartments 42 of the centerwell 38 or grid structure, while the length is limited to a size that is practical to handle. As described above, the buoyancy system advantageously may be modular, and can include more than one buoyancy module to obtain the desired volume, or buoyancy force, while maintaining each individual module at manageable lengths. For example, a first or upper buoyancy module may be provided substantially as described above, while a second or lower buoyancy module may be attached to the first to obtain the desired volume.

Figure 5:
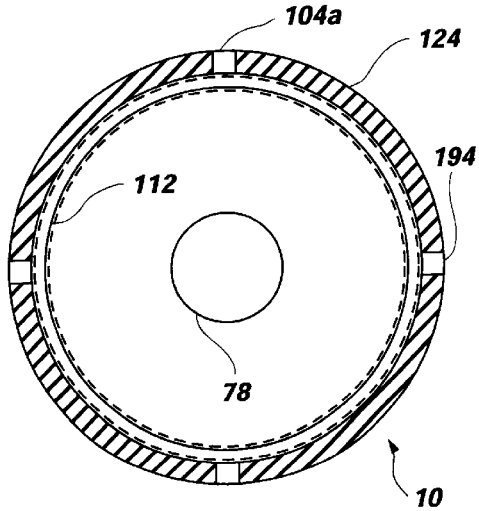
FIG. 5 is a cross-sectional end view of the buoyancy system of FIG. 1 taken along line 5—5.
Figure 6:
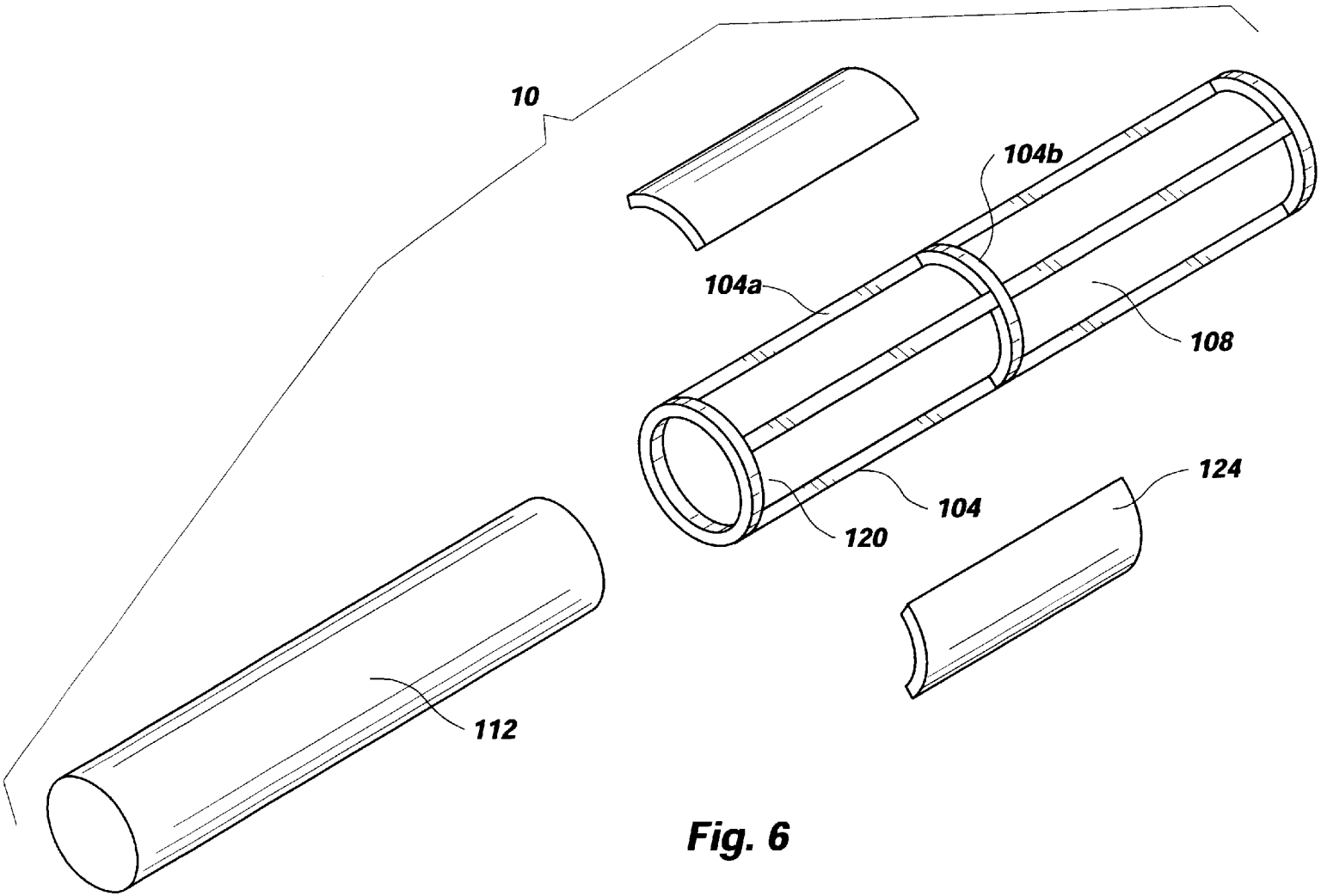
FIG. 6 is a partial exploded view of the buoyancy system of FIG. 1.
Figure 7:
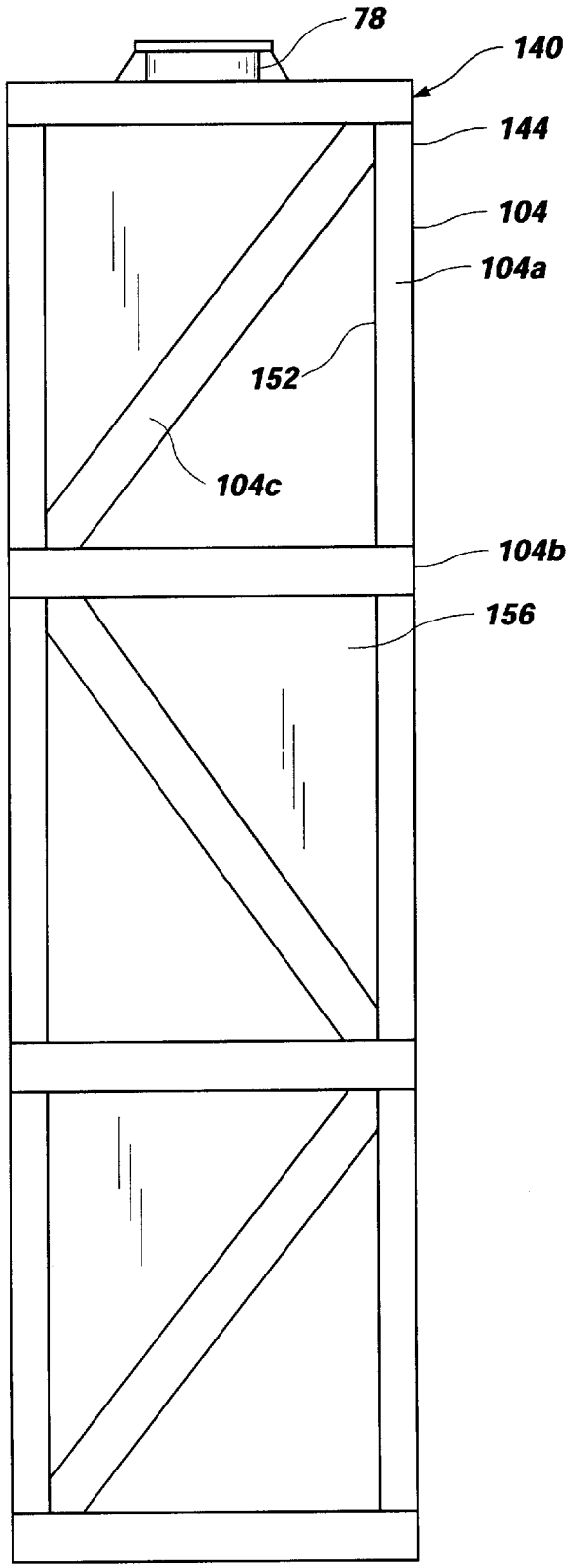
FIG. 7 is a side view of another buoyancy system in accordance with the present invention.
Figure 8:
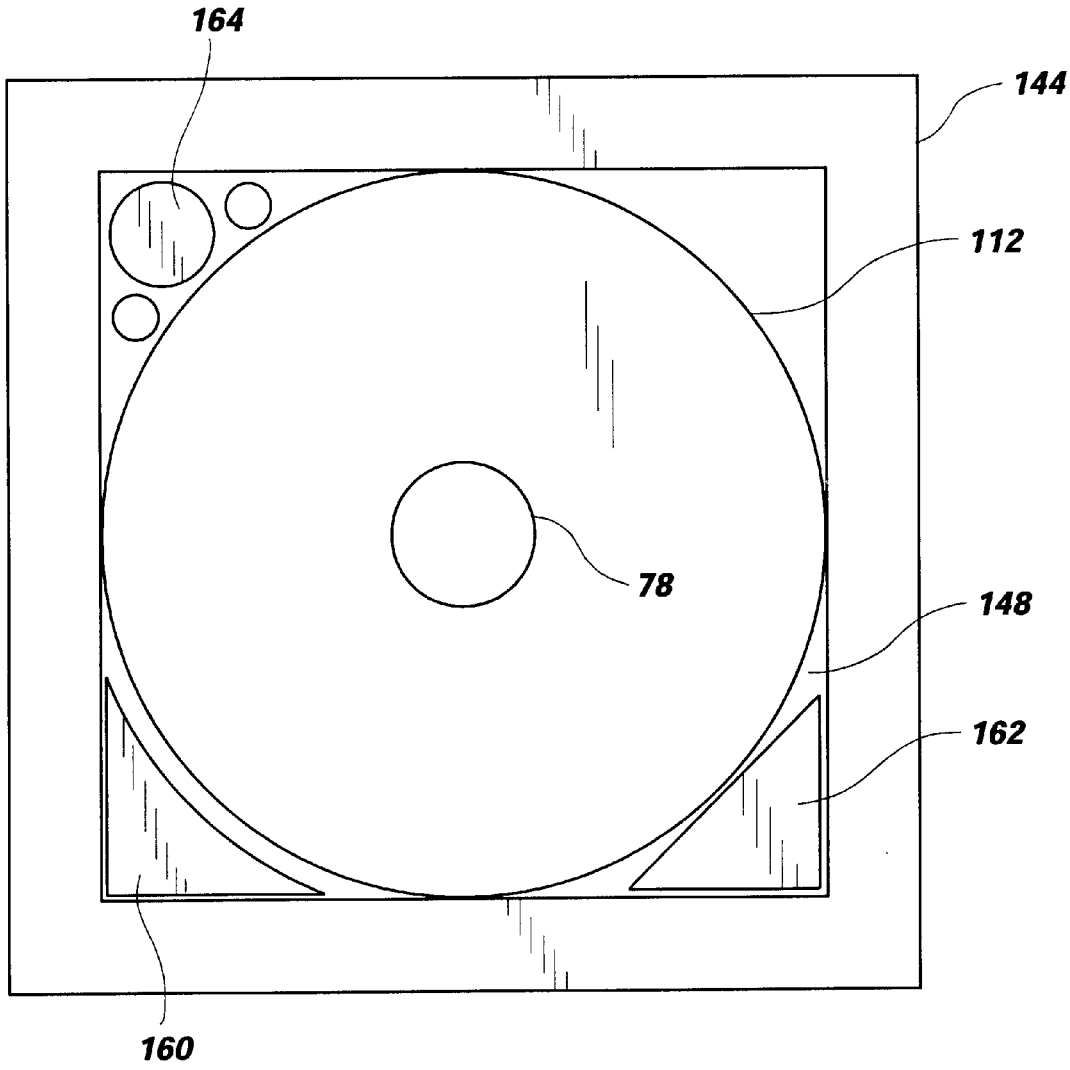
FIG. 8 is an end view of the buoyancy system of FIG. 7.
Figure 9:
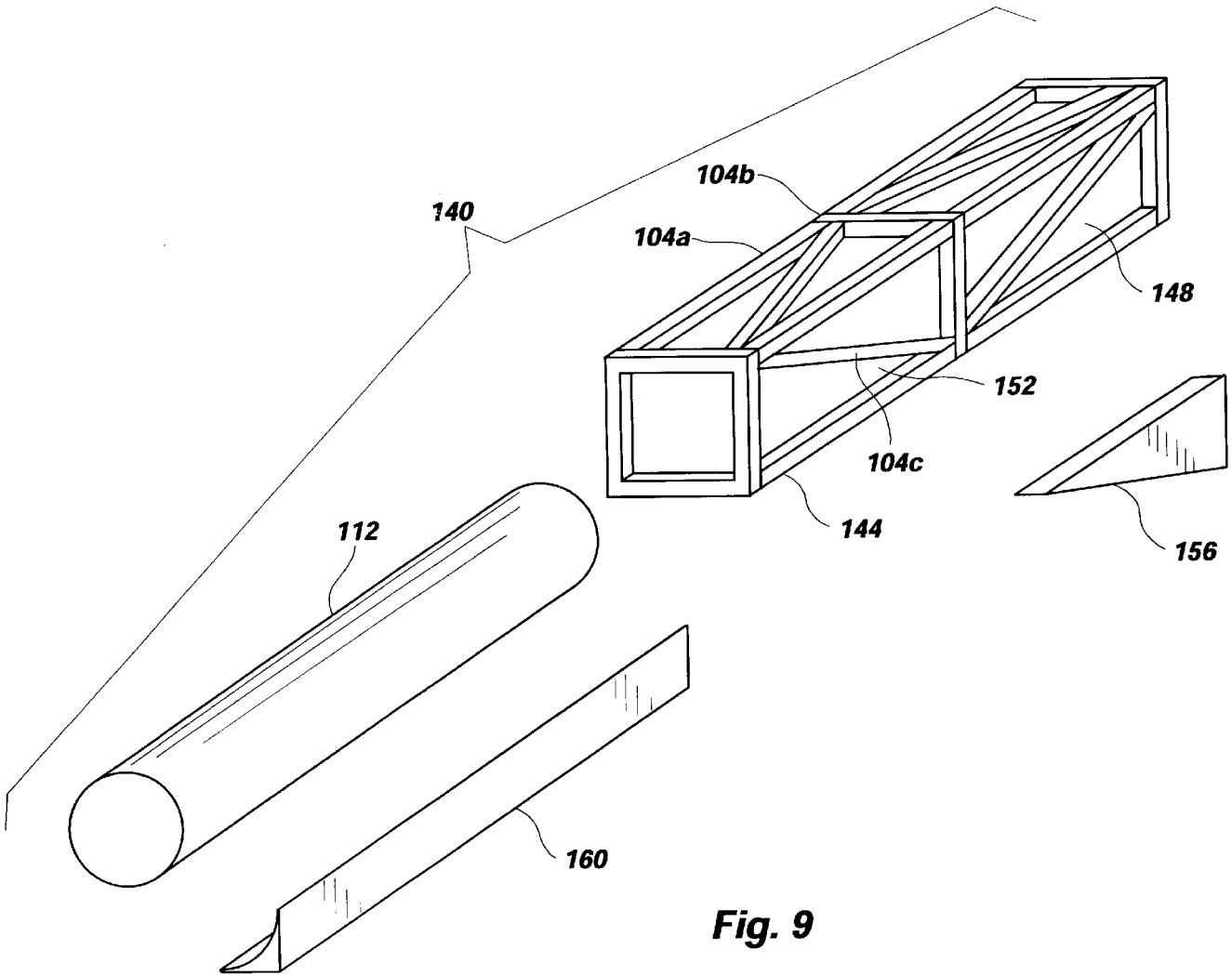
FIG. 9 is a partial exploded view of the buoyancy system of FIG. 7.
Figure 14:
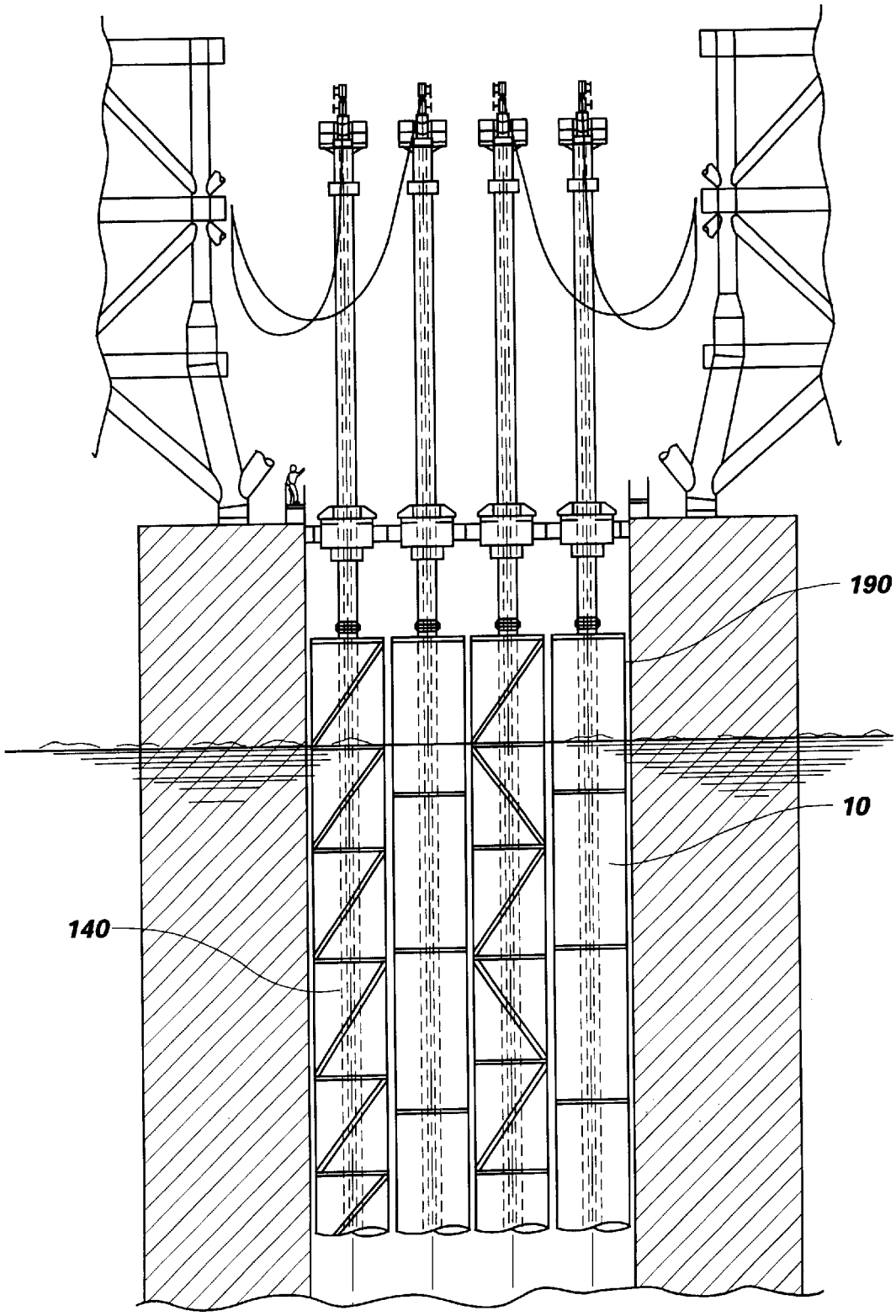
FIG. 14 is partial cross-sectional side view of the floating platform utilizing the buoyancy system of the present invention.

Referring to FIGS. 12 and 14, rollers 190 can be placed between the centerwell 38 and the ecto-skeleton to facilitate movement of the ecto-skeleton in the centerwell 38. The rollers 190 can be attached to either the centerwell 38 or the ecto-skeleton. Alternatively, as shown in FIGS. 5 and 12, a wear strip 194 can be placed between the centerwell 38 and ecto-skeleton, and attached to either or both the centerweel or ecto-skeleton.

In addition, such buoyancy systems also can be attached to the mooring lines, as shown in FIG. 11.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A buoyancy system configured to be couplable to a riser to provide buoyancy for the riser, the system comprising:

a) a rigid ecto-skeleton, configured to be couplable to the riser, defining an interior cavity configured to receive the riser therethrough; and b) a vessel, disposed in the interior cavity of the ecto-skeleton, configured to contain a buoyant material to provide buoyancy for the riser;

e) the ecto-skeleton including a plurality of longitudinal and lateral members forming an external truss framework configured to withstand forces between the riser and a floating platform and to protect the vessel;

f) a plurality of gaps, formed between proximal members of the framework; and g) a plurality of cladding members, each disposed in one of the plurality of gaps around the interior cavity, the cladding members including a buoyant material.

2. A system in accordance with claim 1, wherein the ecto-skeleton and the vessel are configured to be substantially submerged; and wherein the buoyant material in the vessel includes air.

3. A system in accordance with claim 1, wherein the vessel includes a vessel wall with a fiber composite material.

4. A system in accordance with claim 1, wherein the plurality of members of the framework include tubular members having hollow interiors with a buoyant material disposed therein.

5. A system in accordance with claim 1, wherein the ecto-skeleton has a square cross-sectional shape; and wherein the vessel has a circular cross-sectional shape; and further comprising:

a plurality of inserts, disposed in the ecto-skeleton between the framework and the vessel at corners of the square cross-sectional shape, the inserts including a buoyant material.

6. A system in accordance with claim 1, wherein the ecto-skeleton is a first ecto-skeleton of modular configuration, and further comprising:

a) a second ecto-skeleton of modular configuration, attached to the first ecto-skeleton; and b) a plurality of mating protrusions and indentations disposed on the first and second ecto-skeletons.

7. A system in accordance with claim 1, wherein the ecto-skeleton and the vessel have a circular cross-sectional shape.

8. A buoyancy system configured to be couplable to a riser to providing buoyancy for the riser, the system comprising:

a) a rigid ecto-skeleton, configured to be couplable to the riser, defining an interior cavity configured to receive the riser therethrough, the ecto-skeleton including a plurality of members forming an external framework; and b) a vessel, disposed in the interior cavity of the ecto-skeleton, configured to contain a buoyant material to provide buoyancy for the riser; and c) the plurality of members including tubular members having hollow interiors; and d) a buoyant material, disposed in the hollow interiors of the tubular members.

9. A system in accordance with claim 8, wherein the hollow interiors of the tubular members are sized such that the framework is substantially at least neutrally buoyant.

10. A system in accordance with claim 8, wherein the ecto-skeleton has a square cross-sectional shape; and wherein the vessel has a circular cross-sectional shape; and further comprising:

a plurality of inserts, disposed in the ecto-skeleton between the framework and the vessel at corners of the square cross-sectional shape, the inserts including a buoyant material.

11. A system in accordance with claim 8, further comprising:

a) a plurality of gaps, formed between proximal members of the framework; and b) a plurality of cladding members, each disposed in one of the plurality of gaps around the interior cavity, the cladding members including a buoyant material.

12. A system in accordance with claim 8, wherein the ecto-skeleton is a first ecto-skeleton of modular configuration, and further comprising:

a) a second ecto-skeleton of modular configuration, attached to the first ecto-skeleton; and b) a plurality of mating protrusions and indentations disposed on the first and second ecto-skeletons.

13. A system in accordance with claim 8, wherein the ecto-skeleton and the vessel have a circular cross-sectional shape.

14. A system in accordance with claim 8, wherein the plurality of members of the framework include 1) longitudinal members oriented longitudinally with respect to the framework, and 2) lateral members oriented laterally with respect to the framework, the longitudinal and lateral members being connected at intersections.

15. A buoyancy system configured to be couplable to riser to provide buoyancy for the riser, the system comprising:

a) a rigid ecto-skeleton, configured to be couplable to the riser, defining an interior cavity configured to receive the riser therethrough, the ecto-skeleton including a plurality of members forming an external framework, the plurality of members defining a plurality of gaps formed between proximal members of the framework;

b) a vessel, disposed in the interior cavity of the ecto-skeleton, configured to contain a buoyant material to provide buoyancy for the riser; and c) a plurality of cladding members, each disposed in one of the plurality of gaps around the interior cavity, the cladding members including a buoyant material.

16. A system in accordance with claim 15, wherein the ecto-skeleton has a square cross-sectional shape; and wherein the vessel has a circular cross-sectional shape; and further comprising:

a plurality of inserts, disposed in the ecto-skeleton between the framework and the vessel at corners of the square cross-sectional shape, the inserts including a buoyant material.

17. A system in accordance with claim 15, wherein the plurality of members of the framework include tubular members having hollow interiors with a buoyant material disposed therein.

18. A system in accordance with claim 18, wherein the ecto-skeleton is a first ecto-skeleton of modular configuration, and further comprising:

a) a second ecto-skeleton of modular configuration, attached to the first ecto-skeleton; and b) a plurality of mating protrusions and indentations disposed on the first and second ecto-skeletons.

19. A system in accordance with claim 15, wherein the ecto-skeleton and the vessel have a circular cross-sectional shape.

20. A system in accordance with claim 15, wherein the plurality of members of the framework include 1) longitudinal members oriented longitudinally with respect to the framework, and 2) lateral members oriented laterally with respect to the framework, the longitudinal and lateral members being connected at intersections.

21. A buoyancy system configured to be coupled to a riser to provide buoyancy for the riser, the system comprising:

a) a rigid ecto-skeleton, configured to be couplable to the riser, defining an interior cavity configured to receive the riser therethrough, the ecto-skeleton having a square cross-sectional shape;

b) a vessel, disposed in the interior cavity of the ecto-skeleton, configured to contain a buoyant material to provide buoyancy for the riser; and c) a plurality of inserts, disposed in the ecto-skeleton between the ecto-skeleton and the vessel at corners of the square cross-sectional shape, the inserts including a buoyant material.

22. A system in accordance with claim 21, wherein the vessel has a circular cross-sectional shape.

23. A system in accordance with claim 21, wherein the ecto-skeleton includes:

a plurality of members forming an external framework.

24. A system in accordance with claim 23, wherein the plurality of members of the framework include tubular members having hollow interiors with a buoyant material disposed therein.

25. A system in accordance with claim 23, further comprising:

a) a plurality of gaps, formed between proximal members of the framework; and b) a plurality of cladding members, each disposed in one of the plurality of gaps around the interior cavity, the cladding members including a buoyant material.

26. A system in accordance with claim 23, wherein the plurality of members of the framework include 1) longitudinal members oriented longitudinally with respect to the framework, and 2) lateral members oriented laterally with respect to the framework, the longitudinal and lateral members being connected at intersections.

27. A system in accordance with claim 21, wherein the ecto-skeleton is a first ecto-skeleton of modular configuration, and further comprising:

a) a second ecto-skeleton of modular configuration, attached to the first ecto-skeleton; and b) a plurality of mating protrusions and indentations disposed on the first and second ecto-skeletons.

28. A modular buoyancy system configured to be coupled to a riser to provide buoyancy for the riser, the system comprising:

a) a plurality of buoyancy modules, attached together in series, each module including:

1) a rigid ecto-skeleton, configured to be couplable to the riser, defining an interior cavity configured to receive the riser therethrough; and 2) a vessel, disposed in the interior cavity of the ecto-skeleton, configured to contain a buoyant material to provide buoyancy for the riser; and b) adjacent ecto-skeletons being attachable together by a male projection formed on one ecto-skeleton extending into a female indentation on the other ecto-skeleton.

29. A system in accordance with claim 28, wherein each of the ecto-skeletons include:

a plurality of members forming an external framework.

30. A system in accordance with claim 29, wherein the plurality of members of the framework include tubular members having hollow interiors with a buoyant material disposed therein.

31. A system in accordance with claim 29, further comprising:

a) a plurality of gaps, formed between proximal members of the framework; and b) a plurality of cladding members, each disposed in one of the plurality of gaps around the interior cavity, the cladding members including a buoyant material.

32. A system in accordance with claim 29, wherein the plurality of members of the framework include 1) longitudinal members oriented longitudinally with respect to the framework, and 2) lateral members oriented laterally with respect to the framework, the longitudinal and lateral members being connected at intersections.

33. A system in accordance with claim 23, wherein the ecto-skeleton has a square cross-sectional shape; and wherein the vessel has a circular cross-sectional shape; and further comprising:

a plurality of inserts, disposed in the ecto-skeleton between the framework and the vessel at corners of the square cross-sectional shape, the inserts including a buoyant material.

34. A system in accordance with claim 28, wherein the ecto-skeleton and the vessel have a circular cross-sectional shape.

35. A buoyancy system, comprising:

a) a buoyant platform configured to be disposed on or under a surface of an ocean;

b) an elongated riser, coupled to the platform and configured to extend to a floor of the ocean;

c) a rigid ecto-skeleton, at least partially movably disposed within the buoyant platform and couplable to the riser, defining an interior cavity capable of receiving the riser therethrough; and d) a buoyant vessel, disposed in the interior cavity of the ecto-skeleton, containing a buoyant material to provide buoyancy for the riser;

e) the ecto-skeleton including a plurality of longitudinal and lateral members forming an external truss framework to withstand forces between the riser and the platform and to protect the vessel;

f) a plurality of gaps, disposed between proximal members of the framework; and g) a plurality of cladding members, each disposed in one of the plurality of gaps, the cladding members including a buoyant material.

36. A system in accordance with claim 35, wherein the vessel includes a vessel wall with a fiber composite material.

* * * * *